US005314161A

United States Patent [19]

Domanski et al.

[11] Patent Number: 5,314,161

[45] Date of Patent: May 24, 1994

[54] MINE PROP

[75] Inventors: Lothar Domanski, Oberhausen; Rudi Podjadtke, Herne, both of Fed. Rep. of Germany

[73] Assignee: Bochumer Eisenhutte Heintzmann GmbH & Co. KG, Bochum, Fed. Rep. of Germany

[21] Appl. No.: 891,574

[22] Filed: May 29, 1992

[51] Int. Cl.[5] ..... E04G 25/00

[52] U.S. Cl. ..... 248/548; 248/351; 248/354.3; 248/357

[58] Field of Search ..... 248/159, 354.3, 357, 248/405, 548, 900, 351; 52/1; 254/DIG. 1

[56] References Cited

U.S. PATENT DOCUMENTS

| | | | |
|---|---|---|---|
| 1,006,163 | 10/1911 | Winz | 248/548 |
| 3,027,140 | 3/1962 | Holzbach | 248/354.3 |
| 3,222,030 | 12/1965 | Thorpe | 248/354.3 X |
| 3,737,134 | 6/1973 | Foon | 248/354.3 |
| 4,185,940 | 1/1980 | Spies | 405/288 |
| 4,301,989 | 11/1981 | Kallenbach | 248/548 |
| 4,382,721 | 5/1983 | King | 248/548 X |

FOREIGN PATENT DOCUMENTS

| | | | |
|---|---|---|---|
| 62598 | 12/1913 | Austria | 248/354.3 |
| 232990 | 11/1925 | United Kingdom | 248/548 |

OTHER PUBLICATIONS

Brochure published by Dywidag Systems International, Lamont, Ill., entitled "Dywidag Coal Post, The Yieldable Roof Support System".

*Primary Examiner*—David A. Scherbel
*Assistant Examiner*—Derek J. Berger
*Attorney, Agent, or Firm*—Herbert Dubno

[57] ABSTRACT

A mine prop has a post or column formed by two telescopingly interfitted tubes, one of which has a bottleneck configuration over which the other is spread to provide a resistance to telescoping contraction. At the upper end, a nut is rotatable on the post and can advance the threaded spindle engaged therein to brace the prop between the roof and ceiling of a subterranean structure.

7 Claims, 3 Drawing Sheets

MINE PROP

FIELD OF THE INVENTION

Our present invention relates to a mine prop adapted to be braced between the floor and ceiling structures of a subterranean structure, such as a mine gallery, tunnel, drift or chamber and adapted to yield should a load thereon exceed a predetermined magnitude. More particularly, the invention relates to a structure of that type which includes a spindle so that the bracing of the prop between the floor and ceiling structures can be effected by a screwthread assembly.

BACKGROUND OF THE INVENTION

Mine props which can withstand substantial bearing forces are widely used in mining operations and can be braced between the floor and a ceiling structure to be supported by a screwthread manipulation to extend the mine prop. Such props are employed in a gallery, for example, to support a roof cap at a long wall face to be mined in the gallery between the long wall region and the structure behind the mined wall and in drifts or tunnels generally.

By rotation of a threaded spindle, for example, relative to a nut on a post, the prop can be braced between floor and ceiling to withstand the ceiling loads.

Such a prop will act as a rigid post until a predetermined supporting force is overcome. To prevent overloading of the post when the maximum sustainable force is exceeded, the parts of the prop can telescope relative to one another while resisting the movement of the ceiling toward the floor. The prop thus has a certain length over which it can contract controlledly while providing its maximum resistance at the level of the aforementioned maximum force.

Known coal props which can be braced between the floor and roof of the mine gallery are described in the Dywidag brochure published by Dywidag Systems International of Lamont, Ill., and entitled "Dywidag Coal Post, the Yieldable Roof Support System."

In this arrangement, the post is a one-piece tube which receives the spindle nut having a conical conformation.

To brace the prop between the floor and roof, the threaded spindle is rotated. This can be a time-consuming difficult procedure which may not be carried out conveniently. When the maximum load is exceeded, the conical spindle nut is driven into the tube to spread the latter and the resistance to the axial displacement of the nut into the deformable tube defines the load which is sustained during the telescoping collapse of the prop.

Experience has shown that this system does not provide a precisely defined contraction force or resistance to the load which is inducing the collapse of the prop. Furthermore, since the maximum length to which the prop can collapse while providing the aforementioned resistance to such collapse is defined by the length of the spindle, the system requires a very long spindle which can be an expensive part of the device.

Finally, since increasing spindle length means an increased tendency to buckling of the prop along the spindle, the prop has questionable reliability at least when the spindle is fully extended.

Another type of post or prop described as a telescoping support column is described in U.S. Pat. No. 3,737,134. In this system, the post comprises two telescopingly interfitted tubular elements between which a conical member is provided and which generates the resistance to collapse and hence the collapsing force as one tube telescopes into the other when the maximum load on the prop is exceeded. At the top of the upper tube, a spindle is provided which can be rotated to brace the prop against the roof and floor. The spindle may be provided with a cap or a plate which can be attached to a wooden beam or the like.

This system is also not free from the danger of collapse, has the same difficulties with respect to bracing the prop and does not fully resolve all the problems encountered with the earlier prop.

OBJECTS OF THE INVENTION

It is, therefore, the principal object of the present invention to provide a mine prop, coal post or support column for use in subterranean applications, which can be braced between floor and roof of a subterranean structure and which will allow yielding when a predetermined support force is applied to it, but which can be set in place more easily and with less effort, which is more reliable than earlier systems and which can operate without the danger of buckling.

Another object of this invention is to provide an improved mine prop which is free from the drawbacks of the above-described devices.

SUMMARY OF THE INVENTION

These objects and others which will become apparent hereinafter are attained, in accordance with the invention, in a mine prop which comprises:

a lower support tube;

an upper support tube forming a telescoped junction with the lower support tube with one of the tubes being received within another of the tubes to a length sufficient to prevent buckling of the prop at the junction under loading of the prop;

a spindle nut on an upper end of the upper support tube, the spindle nut being rotatable relative to the upper support tube and being braced axially thereagainst;

a threaded spindle threadedly received in the nut, guided axially in the upper support tube with a length sufficient to prevent buckling of the spindle, and axially shiftable by rotation of the nut to brace the prop between a roof and floor of a subterranean structure; and means at the junction for controlled peripheral deformation of at least one of the tubes allowing axial telescoping of the tubes together upon loading of the prop above a predetermined magnitude.

The threaded spindle can reach into the upper tube of the post to a buckling stabilization length while the two tubes of the post can fit together for a buckling stabilizing length, thereby eliminating any danger of buckling altogether.

When "buckling stabilization" is described herein, we mean to indicate that two parts are so interfitted that there will be no tendency of the more slender part to buckle at or within the outer part or for the prop to buckle where the two parts interfit.

The spindle can be provided at its upper end with means for connecting it to the roof or a part of the roof structure, e.g. a roof cap of any conventional design, while the lower support tube of the post usually will be provided at its lower end with a foot element, such as a floor skid, a foot plate or the like.

With the prop of the invention, it is no longer necessary to make the threaded spindle element of a length to accommodate the full telescoping contraction capacity of the prop, i.e. the displacement on collapse.

Indeed, the controlled collapse of the prop is effected by the telescoping of one of the tubes into the other and the resistance and hence the force sustained by the prop on collapse can be controlled by the controlled deformation of the tubes relative to one another, e.g. by the expansion of the outer tube as it is forced over the inner tube. The resistance can be so selected that long telescoping paths can be provided without any danger of buckling.

For application of the bracing force, the spindle nut of the prop of the invention is activated and it can be provided with handles, formations engageable by a spanner or wrench or otherwise so that its activation can be effected with a minimum of effort. As a result, very high bracing forces can be obtained beyond, for the most part, forces which are obtainable when the spindle itself must be rotated.

It will be self-understood that the lower and upper support tubes must interfit to a buckling stabilizing length so that the prop of the invention will be buckling-free in use. It has also been found that the two telescoping tubes can provide a very well-defined collapsing force over a very long collapsing path.

According to a feature of the invention, the lower tube is formed at its upper end with a bottleneck shaped transition between a small diameter portion and a large diameter portion, the small diameter portion being fitted in a buckling-stabilized fashion in the upper support tube.

Upon loading of the prop, post or column with a force exceeding the predetermined support force, the lower edge of the upper tube will be forced over the transition and will be deformed outwardly to create the resistance which is maintained as collapse proceeds.

According to a feature of the invention, the tube walls have substantially the same thickness. The lower tube can have a constant outer diameter below the bottleneck-shaped transition over the entire length for which the tubes can be telescoped together. This outer diameter can correspond to the outer diameter of the upper tube.

Alternatively, the lower tube can be formed below the bottleneck-shaped transition with a larger diameter segment of greater diameter than portions of said lower tube above and below said segment. The larger diameter segment can have an outer diameter corresponding to the outer diameter of the outer tube.

BRIEF DESCRIPTION OF THE DRAWING

The above and other objects, features and advantages of the present invention will become more readily apparent from the following description, reference being made to the accompanying drawing in which.

SPECIFIC DESCRIPTION

In FIGS. 1-3, 5 and 6, we have shown a prop or post 1 which is stressable against the roof and the floor of a subterranean structure and which, in its basic form, comprises a tubular support element 2, 3, a threaded spindle 4 and a spindle nut 5 in which the spindle 4 is threadedly engaged.

Figure 1A:
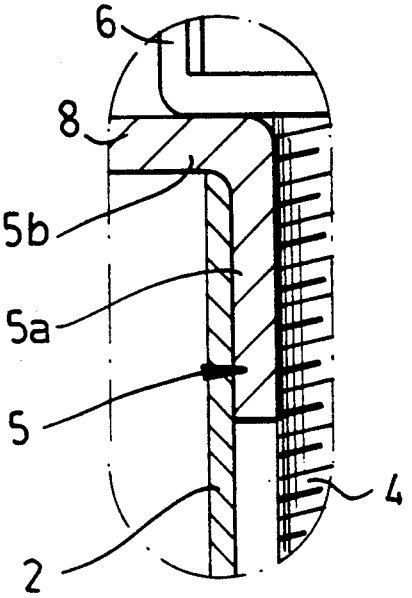
FIG. 1A is a detail section of the region 1A of FIG. 1.
Figure 1:
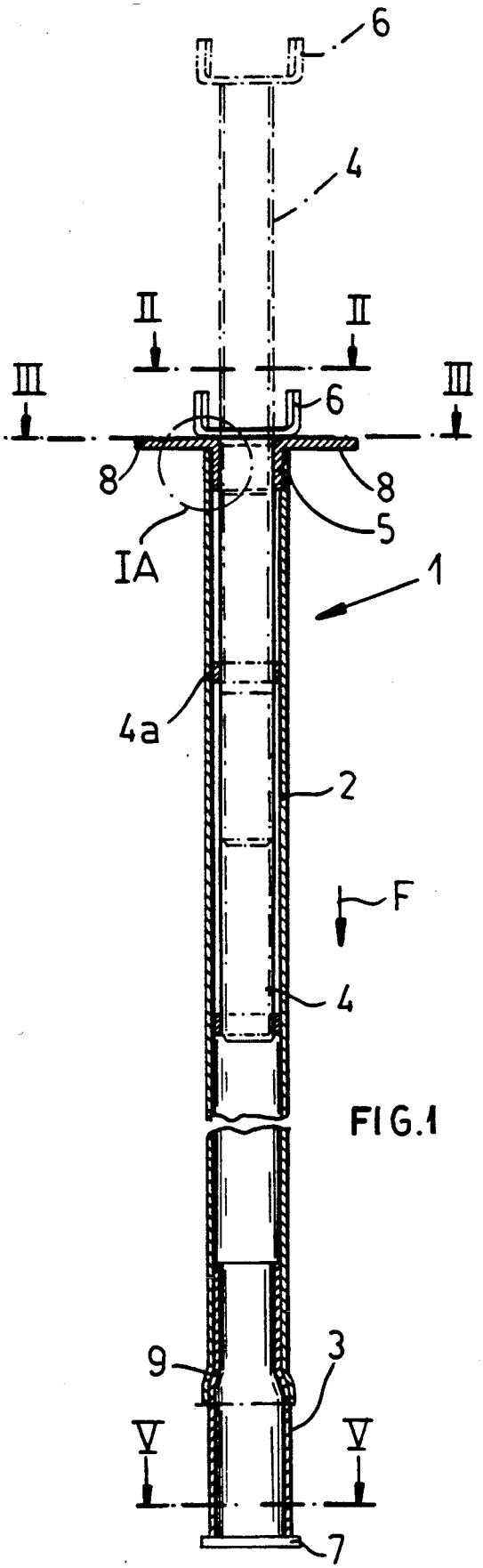
FIG. 1 is a longitudinal section through a prop according to the invention.
Figure 2:
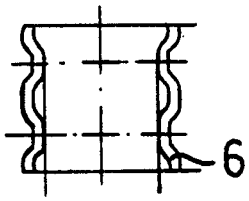
FIG. 2 is a view taken along the line II—II of FIG. 1;; i.e. a plan view of the prop.
Figure 3:
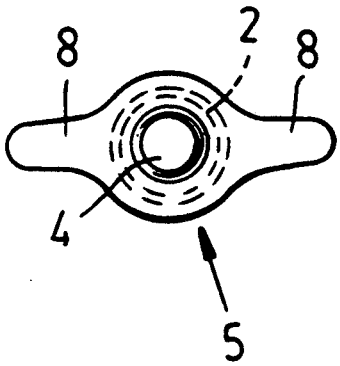
FIG. 3 is a section taken along the line III—III of FIG. 1.

As can be seen from FIG. 1, the support element 2, 3 has an upper support tube 2 and a lower support tube 3.

The spindle nut 5 is rotatably received in the upper tube 2 and comprises, as is apparent from FIG. 1A, an internally-threaded boss 5*a* whose outer diameter corresponds to an inner diameter of the tube 1, and a transverse flange 5*b* connected to the boss 5*a* and provided with formations 8, namely, handles or grips which facilitate rotation of the nut S. The spindle 4 engages within the tube 2 and may be guided via a ring 4*a* thereon. The minimum length of the spindle 4 in the tube 2 is such as to prevent buckling of the spindle or the tube 2 or both together.

Similarly, the upper and lower tubes 2 and 3 telescopingly interengage with a buckling stabilizing length. Under a load exceeding a predetermined supporting force and applied as represented by the arrow F, the upper tube 2 will be spread over the lower tube 3 with a resistance to axial displacement referred to as the contraction force. This contraction force is maintained as the prop yields.

The spindle element 4 is provided at its upper end (see FIG. 2) with a receptacle engageable with a part of the roof structure and here shown as a roof cap 6 adapted to receive a roof bean.

The lower tube 3 is formed at its lower end with a foot element 7 which can be connected to or form part of a horizontal skid adapted to ride along the floor, or adapted to form or be attached to a foot plate. The configuration of the foot element 7 is better seen in FIG. 5.

FIG. 1 shows the threaded spindle 4 fully received in the tube 2 in solid lines. The broken line shown corresponds to an extended position of element 4 resulting from rotation nut 5 via the hand grips 8.

Figure 4A:
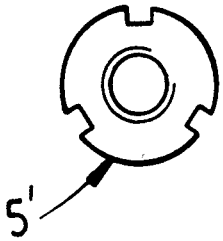
FIG. 4A is a view similar to FIG. 3 but illustrating another embodiment of a spindle nut according to the invention.
Figure 4B:
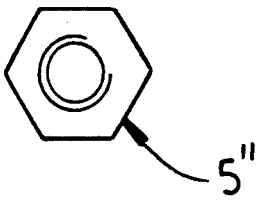
FIG. 4B is a view similar to FIG. 4A showing another embodiment.
Figure 5:
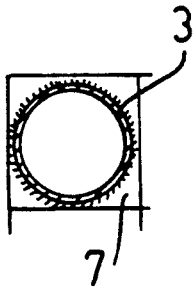
FIG. 5 is a section taken along the line V—V of FIG. 1.

As can be seen from FIGS. 4A and 4B for the nuts 5' and 5'', other tools may be used to engage the flanges.

In FIG. 4A, a spanner may be used to rotate the nut whereas in FIG. 4B, where a hexagonal head is provided on the nut, a long-handled open-end wrench may be used. It will be appreciated that, with the use of such tools, the force with which the prop can be pressed against the roof and ceiling may be practically the maximum support force of the prop.

In the embodiment illustrated in a preferred embodiment of the invention, the lower support tube 3 is provided at its upper end with the bottle-shaped transition 9 (FIG. 6) between a reduced diameter portion 3*a* and a large diameter portion 3*b*, all of circular cross section. The lower edge 2*a* of the tube 2 can thus be forced over the transition and can be spread to generate the resistance to contraction of the telescoping tubes 2, 3. Of course, an inverse configuration is also possible whereby the upper tube 2 can be forced into the lower tube 3.

Figure 6:
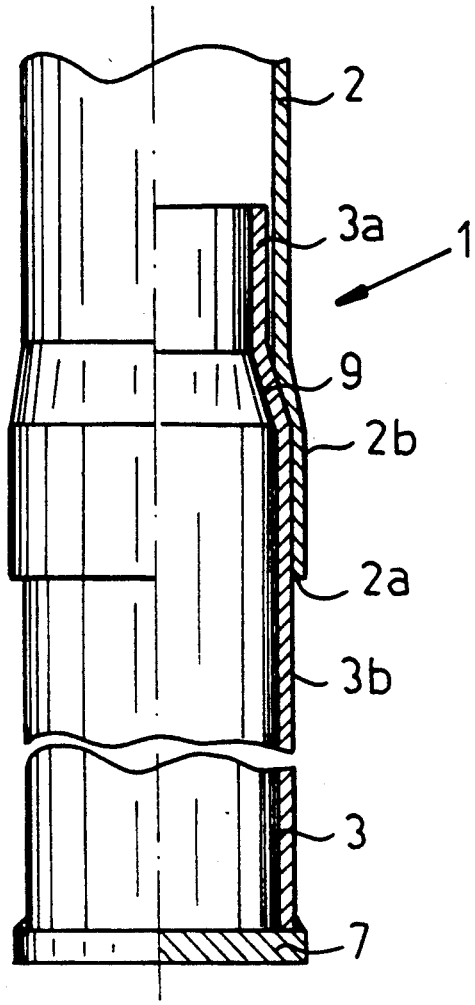
FIG. 6 is a detail view, partly in cross section, showing the telescoping engagement of the outer tube with the inner tube of FIG. 1.

From FIGS. 1 and 6, it will be apparent that in the first embodiment of the invention, the diameter of the tube 3 below the transition 9 is constant over the entire length thereof, determining the maximum contraction length of the prop. The outer diameter of the portion 3*b* can correspond to the outer diameter of the tube 2 above the outwardly spread portion 2*b*.

Figure 7:
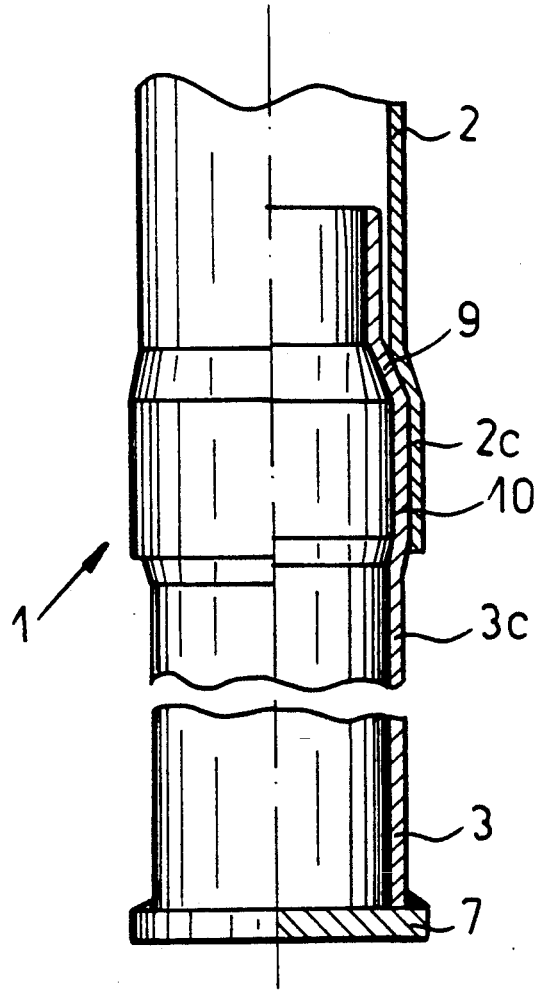
FIG. 7 is a view similar to FIG. 6 of another embodiment.

In the embodiment of FIG. 7, by contrast, the large diameter segment 10 is followed by a reduced diameter portion 3*c* below this segment. The diameter of the large diameter segment 10 here corresponds to the outer diameter of the tube above the outwardly spread segment 2*c*.

It has been found to be advantageous for both the upper tube 2 and the lower tube 3 to have the same wall thickness.

It is an important advantage of the invention that the prop 1 be capable of multiple use and, for that purpose, one need only cut off the deformed tube end and weld on a new yieldable section to replace it.

We claim:

1. A mine prop, comprising:

a lower support tube;

an upper support tube forming a telescoped junction with said lower support tube of circular cross section with one of said tubes being received within another of said tubes to a length sufficient to prevent buckling of said prop at said junction under loading of said prop;

a spindle nut on an upper end of said upper support tube, said spindle nut being rotatable relative to said upper support tube and being braced axially thereagainst;

a threaded spindle threadedly received in said nut, guided axially in said upper support tube with a length sufficient to prevent buckling of said spindle, and axially shiftable by rotation of said nut to brace said prop between a roof and floor of a subterranean structure; and means at said junction for controlled peripheral deformation of at least one of these tubes allowing axial telescoping of said tubes together upon loading of the prop above a predetermined magnitude, said means at said junction including a bottle-neck-shaped reduction in diameter of an upper end of said lower tube extending in a buckling-stabilized manner into a lower end of said upper tube, the upper tube, at said loading of the prop above said predetermined magnitude, having its lower edge slide over said bottle-neck-shaped reduction and deformed outwardly thereby to determine a force required to telescope said tubes together, said lower tube having a constant outer diameter below said bottle-neck-shaped reduction over an entire length over which said tubes can be telescoped together.

2. The mine prop defined in claim 1 wherein said tubes have substantially the same wall thickness.

3. The mine prop defined in claim 1 wherein said outer diameter corresponds to an outer diameter of said upper tube.

4. The mine prop defined in claim 3 wherein said tubes have substantially the same wall thickness.

5. A mine prop, comprising:

a lower support tube;

an upper support tube forming a telescoped junction with said lower support tube of circular cross section with one of said tubes being received within another of said tubes to a length sufficient to prevent buckling of said prop at said junction under loading of said prop;

a spindle nut on an upper end of said upper support tube, said spindle nut being rotatable relative to said upper support tube and being braced axially thereagainst;

a threaded spindle threadedly received in said nut, guided axially in said upper support tube with a length sufficient to prevent buckling of said spindle, and axially shiftable by rotation of said nut to brace said prop between a roof and floor of a subterranean structure; and means at said junction for controlled peripheral deformation of at least one of these tubes allowing axial telescoping of said tubes together upon loading of the prop above a predetermined magnitude, said means at said junction including a bottle-neck-shaped reduction in diameter of an upper end of said lower tube extending in a buckling-stabilized manner into a lower end of said upper tube, the upper tube, at said loading of the prop above said predetermined magnitude, having its lower edge slide over said bottle-neck-shaped reduction and deformed outwardly thereby to determine a force required to telescope said tubes together, below said bottle-neck-shaped reduction, said lower tube being formed with a larger-diameter segment of greater diameter than portions of said lower tube above and below said segment.

6. The mine prop defined in claim 5 wherein said larger-diameter segment has an outer diameter corresponding to an outer diameter of said upper tube.

7. The mine prop defined in claim 6 wherein said tubes have substantially the same wall thickness.

* * * * *